US011140935B2

(12) United States Patent
Ho

(10) Patent No.: US 11,140,935 B2
(45) Date of Patent: Oct. 12, 2021

(54) METHOD FOR APPLYING EYELASH EXTENSIONS

(71) Applicant: Karling Beauty Company, Hsinchu (TW)

(72) Inventor: Chia-Ling Ho, Hsinchu (TW)

(73) Assignee: KARTING BEAUTY COMPANY, Hsinchu (TW)

( * ) Notice: Subject to any disclaimer, the term of this patent is extended or adjusted under 35 U.S.C. 154(b) by 92 days.

(21) Appl. No.: 16/665,983

(22) Filed: Oct. 28, 2019

(65) Prior Publication Data

US 2021/0100305 A1 Apr. 8, 2021

(30) Foreign Application Priority Data

Oct. 3, 2019 (TW) ..... 108135790

(51) Int. Cl.
*A41G 5/02* (2006.01)

(52) U.S. Cl.
CPC ..... *A41G 5/02* (2013.01)

(58) Field of Classification Search
CPC . A41G 5/00; A41G 5/02; A41G 5/008; A41G 3/00; A41G 3/005; A41G 3/0041; A41G 3/0066; A41G 3/0075; A45D 2/48; A45D 40/00; A45D 40/30; A45D 2200/00; A45D 2200/1072; A45D 7/00; A45D 44/00
USPC ..... D28/35–36; 132/56, 216
See application file for complete search history.

(56) References Cited

U.S. PATENT DOCUMENTS 3,200,823 A * 8/1965 Sebastian ..... A41G 5/02 132/216
8,061,367 B2 * 11/2011 Rabe ..... A41G 5/02 132/216
8,113,218 B2 2/2012 Nguten
(Continued)

FOREIGN PATENT DOCUMENTS

CN 106579620 B 1/2018
CN 208972724 U 6/2019
TW M466557 U 12/2013
(Continued)

*Primary Examiner* — Rachel R Steitz
*Assistant Examiner* — Karim Asqiriba
(74) *Attorney, Agent, or Firm* — Muncy, Geissler, Olds and Lowe, P.C.

(57) ABSTRACT

A method for applying eyelash extensions includes: transporting an eyelash extension bundle to an eyelash extensions applying auxiliary, the eyelash extensions each having an attaching end, a root and a distal end, the eyelash extensions applying auxiliary having an attaching reference point, a first reference line and a second reference line, the first and second reference lines or imaginary extension lines thereof being joined at the attaching reference point; the attaching ends of the eyelash extensions being located right at the attaching reference point after the transportation; aligning two of the eyelash extensions in the eyelash extension bundle with the first and second reference lines, respectively, with a pair of tweezers; coating the attaching ends of the eyelash extensions with adhesive, and adhering the attaching ends coated with the adhesive to a root of a human eyelash. Thereby, eyelash extension bundles can all have uniform open angles with enhanced applying quality.

4 Claims, 6 Drawing Sheets

(56) References Cited

U.S. PATENT DOCUMENTS

| | | | | |
|---|---|---|---|---|
| 2017/0029203 | A1* | 2/2017 | Dinh | A41G 5/02 |
| 2018/0360148 | A1* | 12/2018 | Dinh | A41G 5/02 |

FOREIGN PATENT DOCUMENTS

| | | | | |
|---|---|---|---|---|
| TW | M516880 | U | | 2/2016 |
| TW | M541752 | U | | 5/2017 |
| TW | 202017492 | A | * | 11/2018 |

* cited by examiner

METHOD FOR APPLYING EYELASH EXTENSIONS

BACKGROUND OF THE INVENTION

Field of the Invention

The present invention relates generally to a method for applying artificial eyelash extensions onto human eyelashes.

Description of the Prior Art

Eyelash extensions are used to enhance the length, curliness, fullness, and thickness of natural eyelashes. Normally one or more eyelash extensions can be applied to one natural eyelash. When multiple eyelash extensions are applied to a natural eyelash, they are usually recognized as 2D, 3D, 4D, 5D or 6D volume eyelash extensions depending on the number of the eyelash extensions in one bundle. Volume eyelash extensions are normally made in a fan shape. Taking 6D volume eyelash extensions as an example, it is ideally fanning with eyelash extensions equidistantly arranged in a fan shape.

Nevertheless, the eyelash extensions in the volume eyelash extensions are often unevenly distributed due to the operation error of the operator. Opening angles of different volume eyelash extensions are frequently different from each other as well. These make the applied eyelash extensions appear messy and not beautiful enough. Besides, conventional applying method is also time consuming and can cause waste of eyelash extensions.

SUMMARY OF THE INVENTION

In view of the foregoing, one object of the present invention is to provide a method for applying eyelash extensions which can assist the operator to make volume eyelash extensions with consistent opening angles.

To achieve the above and other objects, the present invention provides a method for applying eyelash extensions comprising the following steps:

(A) transporting an eyelash extension bundle, which comprises multiple eyelash extensions, to an eyelash extensions applying auxiliary, each of the eyelash extensions having an attaching end, a root adjacent to the attaching end, and a distal end, the eyelash extensions applying auxiliary having an attaching reference point, a first reference line and a second reference line, the first and second reference lines or imaginary extension lines thereof being joined at the attaching reference point, in which the attaching ends of the eyelash extensions are located right at the attaching reference point after the transportation;

(B) aligning two of the eyelash extensions in the eyelash extension bundle with the first and second reference lines, respectively, with a pair of tweezers; and (C) lifting the eyelash extension bundle by holding the roots of the eyelash extensions with the pair of tweezers or with another pair of tweezers, coating the attaching ends of the eyelash extensions with adhesive, and adhering the attaching ends coated with the adhesive to a root of a natural eyelash.

Through the above method, the eyelash extension bundles can all have uniform open angles, thereby improving the quality of the application of the eyelash extensions, and reducing the applying time and the waste of the eyelash extension.

DETAILED DESCRIPTION OF THE PREFERRED EMBODIMENTS

Figure 1:
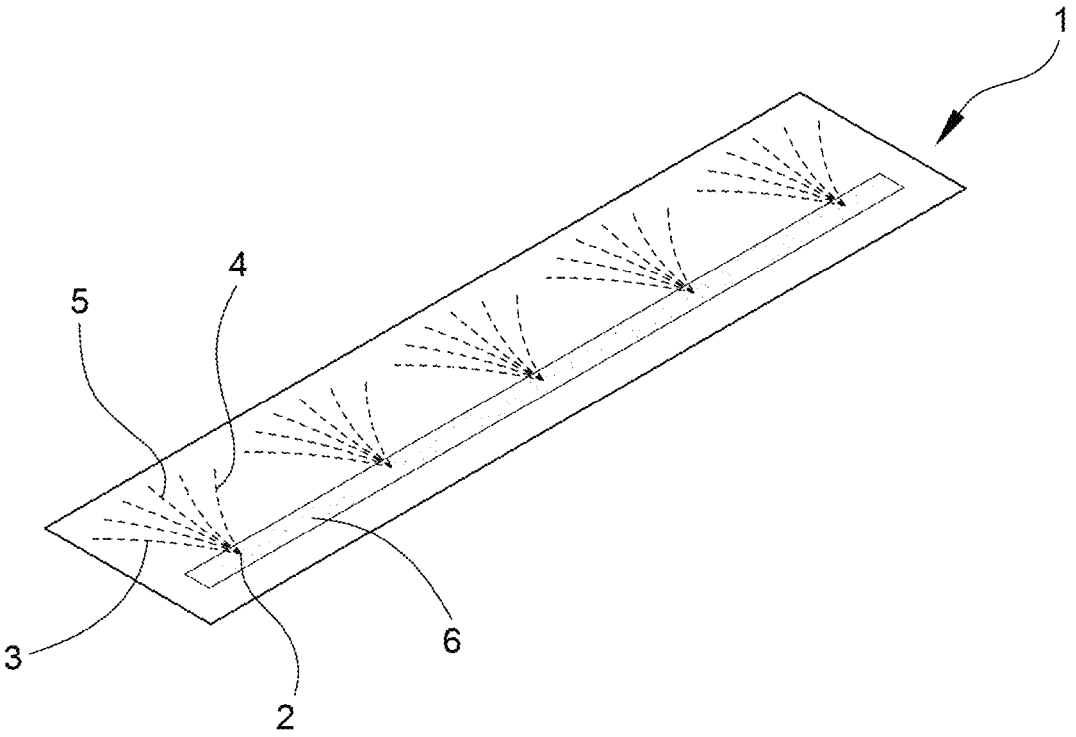
FIG. 1 is a perspective drawing of an eyelash extensions applying auxiliary used in the present invention.

The method for applying eyelash extensions of the present invention is a method for assisting an eyelash-applying operator to make volume eyelash extensions with consistent opening angles. The present method utilizes an eyelash extensions applying auxiliary 1 as shown in FIG. 1, for example. The eyelash extensions applying auxiliary 1 is, for example, a card depicted with an attaching reference point 2, a first reference line 3, a second reference line 4 and multiple intermediate reference lines 5. In possible embodiments, the first and second reference lines 3, 4 could be an arc line or a straight line. The first and second reference lines 3, 4 themselves or imaginary extension lines thereof are joined at the attaching reference point 2. The intermediate reference lines 5 are located at equal intervals from each other between the first and second reference lines 3, 4, and the intermediate reference lines 5 themselves or imaginary extension lines thereof are also joined at the attaching reference point 2. To temporarily fix eyelash extensions, the eyelash extensions applying auxiliary 1 further has an adhesive strip 6 overlapping the attaching reference point 2. In other possible embodiments, the eyelash extensions applying auxiliary could be a self-adhesive silicone sheet or the like, depicted with the attaching reference point 2 and those reference lines. The adhesive strip is not necessary in these self-adhesive elements.

The following is a description of how to utilize the aforementioned eyelash extensions applying auxiliary 1 to apply eyelash extensions through FIGS. 2 to 10.

Figure 2:
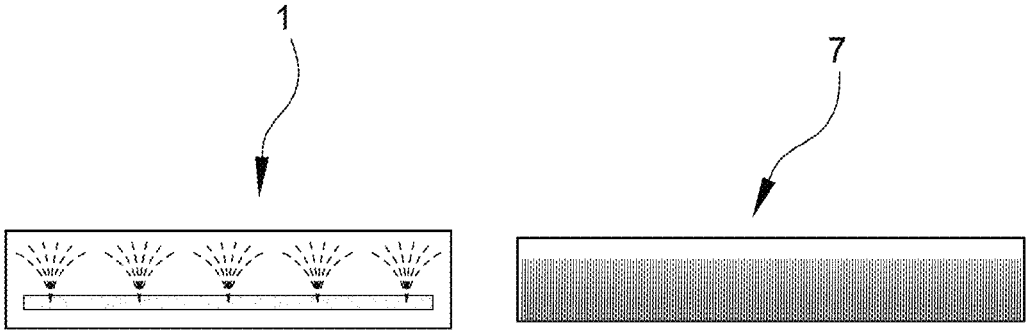
FIGS. 2 to 10 show steps in accordance with an embodiment of the present invention.

Please refer to FIG. 2. First of all, prepare the eyelash extensions applying auxiliary 1 and a row of eyelash extensions 7 arranged parallel with each other.

Figure 3:
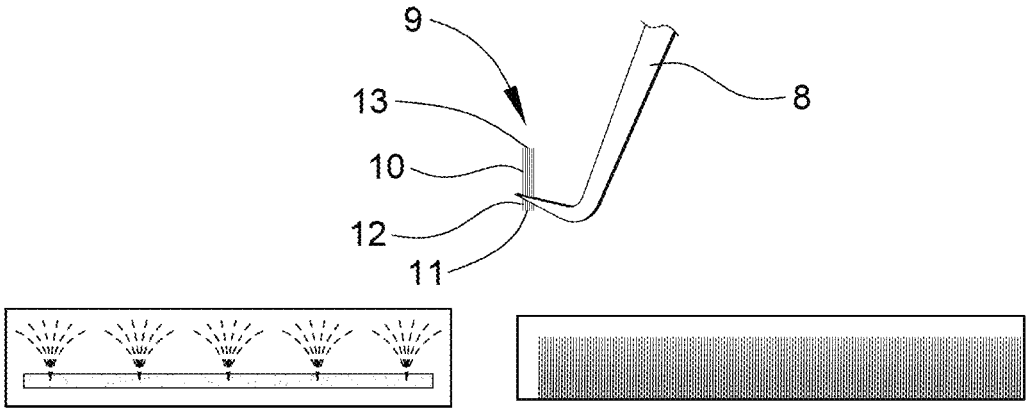

As shown in FIG. 3, lift an eyelash extension bundle 9 with a pair of tweezers 8, in which the number of eyelash extensions in the eyelash extension bundle 9 is not less than the number of eyelash extensions to be applied onto a natural eyelash. Each of the eyelash extensions 10 has an attaching end 11, a root 12 adjacent to the attaching end 11, and a distal end 13. The root 12 is a portion approximately 2-3 mm away from the attaching end 11.

Figure 4:
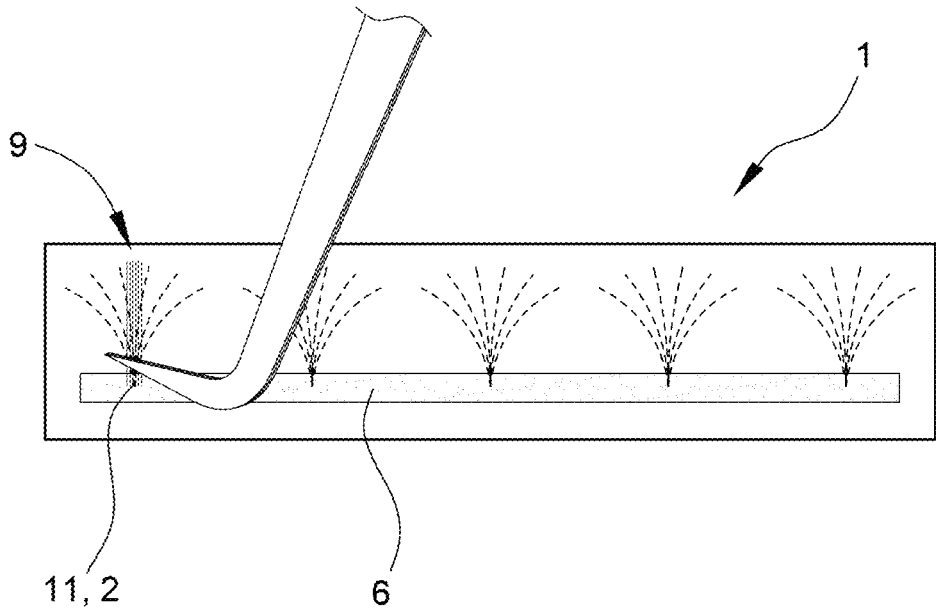

As shown in FIG. 4, transport the eyelash extension bundle 9 to the eyelash extensions applying auxiliary 1. After transportation, the attaching end 11 is located right at the attaching reference point 2 and temporarily adhered on the adhesive strip 6.

Figure 5:
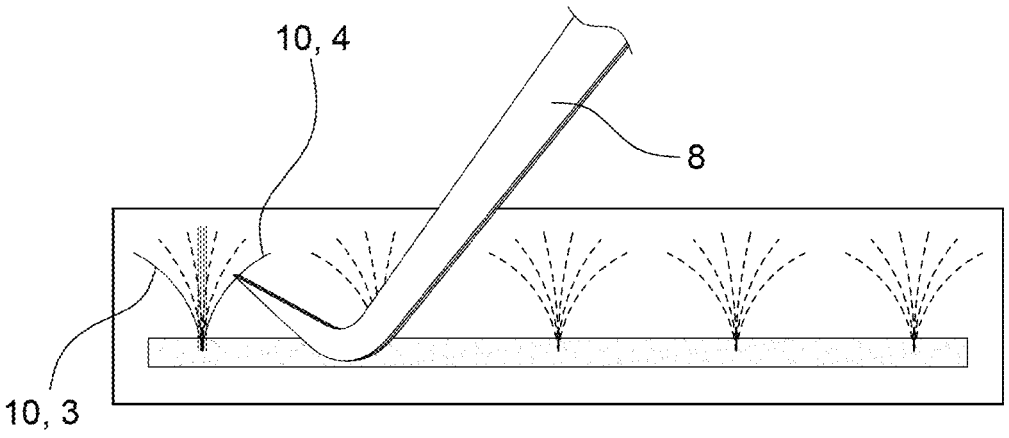
Figure 6:
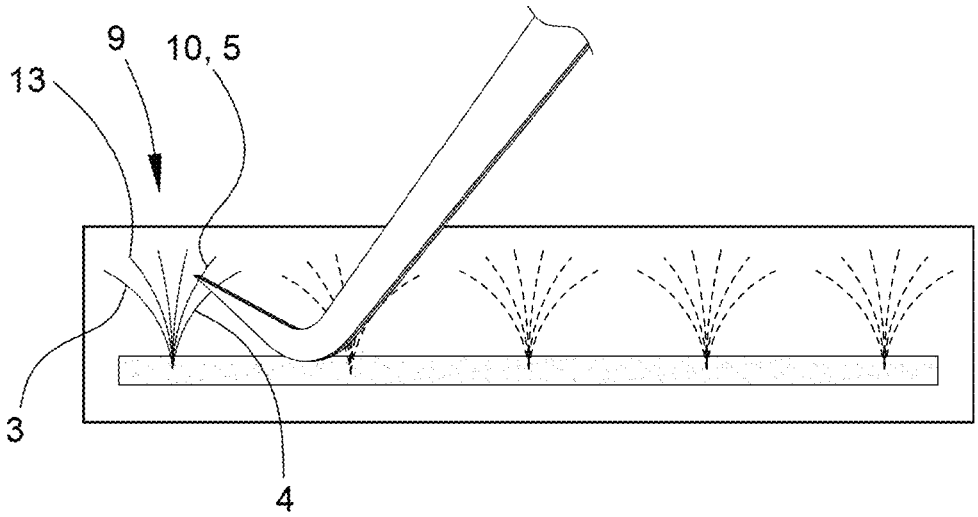

As shown in FIG. 5, align the two outermost eyelash extensions 10 in the eyelash extension bundle 9 with the first and second reference lines 3, 4, respectively with the tweezers 8. Then, as shown in FIG. 6, split the rest of the eyelash extensions 10 to align with the intermediate reference lines 5, respectively, with the tweezers 8 to make the distal ends 13 of all the adjacent eyelash extensions 10 substantially equidistantly spaced. The eyelash extensions 10 aligning with the first and second reference lines 3, 4 would be the two outermost eyelash extensions 10 among all the eyelash extensions 10. A total number of the eyelash extensions 10 is equal to a total number of the intermediate reference lines 5 plus the first and second reference lines 3, 4. If the number of the eyelash extensions 9 is larger then the total number of the intermediate reference lines 5 plus the first and second reference lines 3, 4, then extra eyelash extensions will be removed. In other possible embodiments, the eyelash extensions could be split from left to right or from right to left to align with the first and second reference lines and the intermediate reference lines, respectively.

Figure 7:
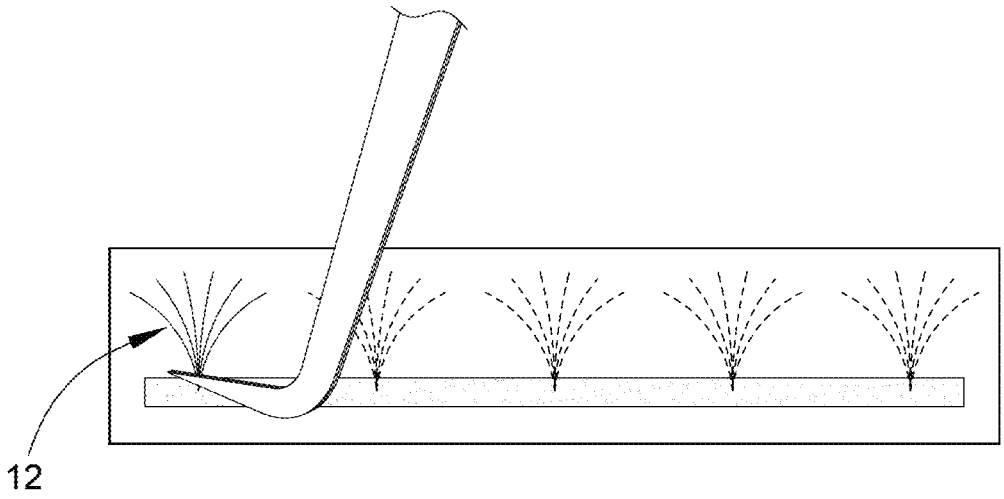
Figure 8:
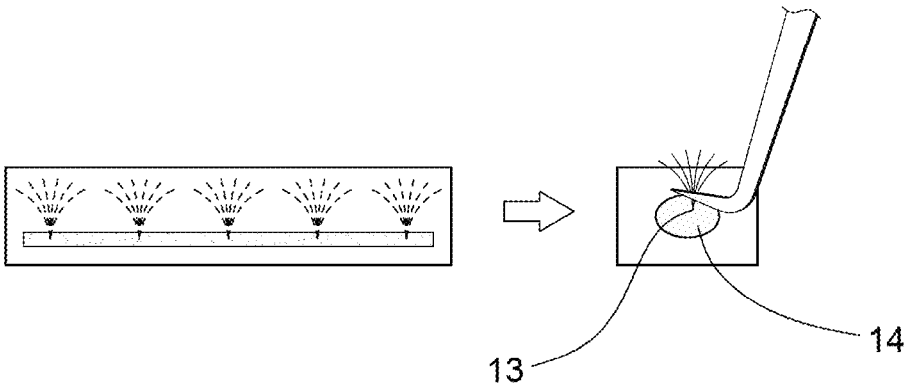
Figure 9:
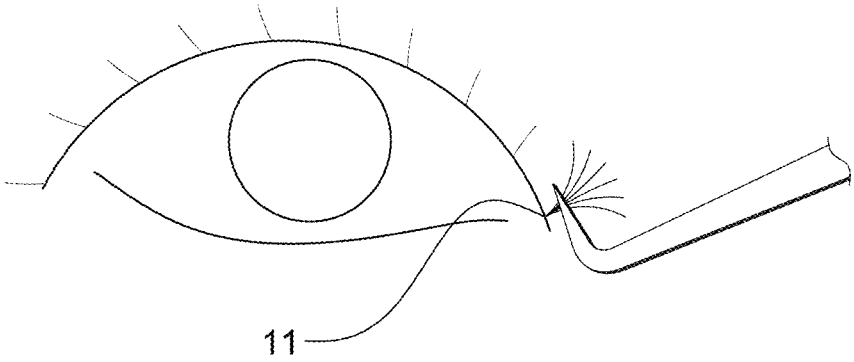

As shown in FIG. 7, lift the eyelash extension bundle by holding the roots 12 of the eyelash extensions with the tweezers, coat the attaching ends 11 of the eyelash extensions with adhesive 14 as shown in FIG. 8. Then, as shown in FIG. 9, adhere the attaching ends 11 coated with the adhesive to a root of a natural eyelash (about 0.5-1 mm from human eyelid). The application of the eyelash extension bundle is then accomplished.

Figure 10:
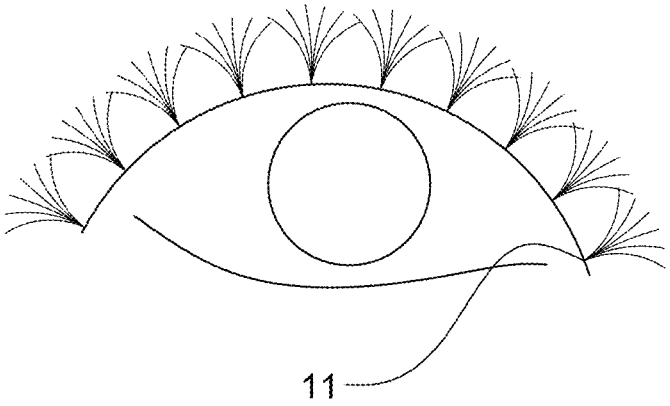

As shown in FIG. 10, repeat the above steps to apply multiple eyelash extension bundles onto multiple natural eyelashes, respectively. Multiple volume eyelash extensions can thus be made with orderliness, uniform opening angles and even eyelash distribution. Through the eyelash extensions applying auxiliary utilized in the present invention, even rookies in this business can easily make the volume eyelash extensions with uniform opening angles and even eyelash distribution, which is beneficial to the development of the industry.

Figure 11:
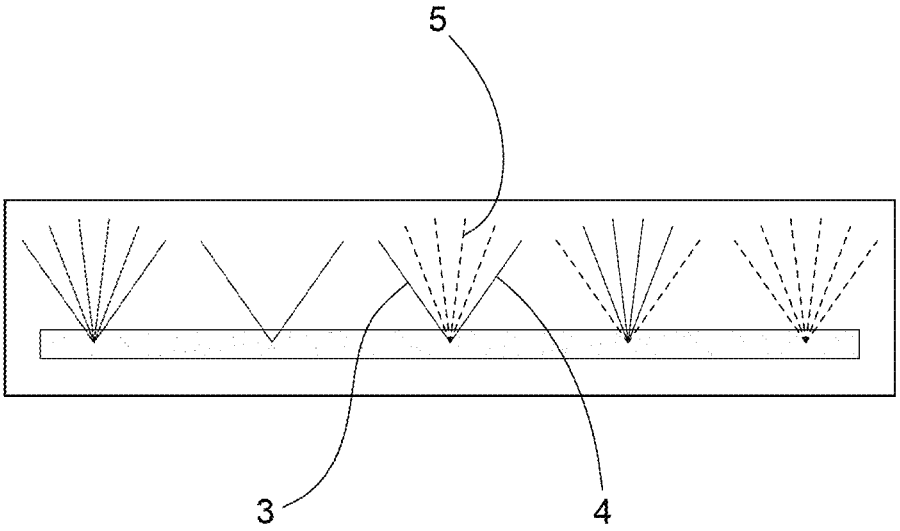
FIG. 11 is a perspective drawing of another eyelash extensions applying auxiliary used in the present invention.

In the aforementioned embodiment, the first and second reference lines 3, 4 and the intermediate reference lines 5 are depicted in dash lines. In other possible embodiments, these reference lines can be all or partially depicted in solid lines or other line types. In other possible embodiments, only the first and second reference lines are depicted while the intermediate reference lines are not shown. This type of eyelash extensions applying auxiliaries can be used to ensure every volume eyelash extensions to be make with uniform opening angles. The eyelash extensions applying auxiliary shown in FIG. 11 exemplarily shows several possible types of the reference lines.

It is to be noted that, depending on the operator's habits, the operator can use the same tweezers to perform all the applying steps, or use different tweezers in different applying steps.

What is claimed is:

1. A method for applying eyelash extensions, comprising the following steps:

(A) transporting an eyelash extension bundle, which comprises multiple eyelash extensions, to an eyelash extensions applying auxiliary, each of the eyelash extensions having an attaching end, a root adjacent to the attaching end, and a distal end, the eyelash extensions applying auxiliary having an attaching reference point, a first reference line and a second reference line, the first and second reference lines or imaginary extension lines thereof being joined at the attaching reference point, in which the attaching ends of the eyelash extensions are located right at the attaching reference point after the transportation;

(B) aligning two of the eyelash extensions in the eyelash extension bundle with the first and second reference lines, respectively, with a pair of tweezers, the eyelash extensions aligning with the first and second reference lines are the two outermost eyelash extensions among all the eyelash extensions;

(C) lifting the eyelash extension bundle by holding the roots of the eyelash extensions with the pair of tweezers or with another pair of tweezers, coating the attaching ends of the eyelash extensions with adhesive, and adhering the attaching ends coated with the adhesive to a root of a natural eyelash; and (D) wherein the eyelash extensions applying auxiliary has multiple intermediate reference lines, which located at equal intervals from each other between the first and second reference lines, the intermediate reference lines or imaginary extension lines thereof are joined at the attaching reference point, a total number of the intermediate reference lines plus the first and second reference lines is equal to a total number of the eyelash extensions, the said "poking the eyelash extensions other than those aligning with the first and second reference lines with one of the pairs of tweezers or with yet another pair of tweezers to make the distal ends of all adjacent eyelash extensions substantially equidistantly spaced" means aligning the eyelash extensions other than those aligning with the first and second reference lines with the intermediate reference lines, respectively, with one of the pairs of tweezers.

2. The method for applying eyelash extensions of claim 1, wherein the eyelash extension bundle has at least three of the eyelash extensions, the step (B) further comprises:

splitting the eyelash extensions other than those aligning with the first and second reference lines with one of the pairs of tweezers or with yet another pair of tweezers to make the distal ends of all the adjacent eyelash extensions substantially equidistantly spaced.

3. The method for applying eyelash extensions of claim 1, wherein the eyelash extensions applying auxiliary further has an adhesive strip overlapping the attaching reference point, in which the attaching ends of the eyelash extensions are adhered to the adhesive strip after the transportation.

4. The method for applying eyelash extensions of claim 1, wherein the eyelash extensions in the eyelash extension bundle are parallel to each other before the transportation.

* * * * *